US005306208A

United States Patent [19]

Sommerrock et al.

[11] Patent Number: 5,306,208

[45] Date of Patent: Apr. 26, 1994

[54] APPARATUS FOR THE VENTILATION OF THE PASSENGER SPACE OF RAPIDLY MOVING ELEVATOR CARS

[75] Inventors: Brigitte Sommerrock; Rolf Günther, both of München, Fed. Rep. of Germany; Urs Minder, Luzern, Switzerland

[73] Assignee: Inventio AG, Hergiswil NW, Switzerland

[21] Appl. No.: 986,142

[22] Filed: Dec. 4, 1992

[30] Foreign Application Priority Data

Dec. 4, 1991 [CH] Switzerland ..... 03561/91-3

[51] Int. Cl.[5] ..... F24F 13/20

[52] U.S. Cl. ..... 454/68; 454/254

[58] Field of Search ..... 454/68, 88, 118, 276, 454/254

[56] References Cited

U.S. PATENT DOCUMENTS

| | | | |
|---|---|---|---|
| 1,872,007 | 8/1932 | Reilly | 454/68 |
| 2,034,723 | 3/1936 | Fitch | 454/88 X |
| 2,265,623 | 12/1941 | Bonsall | 454/88 |
| 2,305,141 | 12/1942 | Crede | 454/88 |
| 2,350,389 | 6/1944 | Coulton . | |
| 2,532,268 | 11/1950 | Christmann . | |
| 5,080,003 | 1/1992 | Kappeler | 454/68 |

FOREIGN PATENT DOCUMENTS

| | | | |
|---|---|---|---|
| 1346555 | 10/1987 | U.S.S.R. | 454/68 |

*Primary Examiner*—Harold Joyce
*Attorney, Agent, or Firm*—Howard & Howard

[57] ABSTRACT

An apparatus for ventilating the passenger space of a rapidly moving elevator car generates an air flow through the car during the travel of the car in an elevator shaft. A plurality of ventilation slots are provided one above the other and open to the passenger space of the elevator car and to a ventilation channel extending vertically in one wall of the elevator car. The total cross-sectional area of the ventilation slots is approximately twice as great as the cross-sectional area of the ventilation channel. The ventilation slots are formed by carrier slots in a sheet metal carrier on which a plurality of strips of a laminated material plate are attached on a passenger space side thereof and on which a perforated metal reinforcing plate is spot-welded on a rear side thereof. The reinforcing plate has rows of apertures formed in generally V-shaped grooves aligned with the ventilation slots. The grooves space the apertures from the carrier. The cross-sectional area of the apertures in any groove is at least equal to the cross-sectional area of the associated ventilation slot.

11 Claims, 3 Drawing Sheets

APPARATUS FOR THE VENTILATION OF THE PASSENGER SPACE OF RAPIDLY MOVING ELEVATOR CARS

BACKGROUND OF THE INVENTION

The present invention relates generally to elevator cars and, in particular, to an apparatus for ventilating the passenger space of rapidly moving elevator cars.

Equipment for the ventilation of rapidly moving elevator cars is shown in the European patent document EP-A O 418 511 in which air, which is situated in the elevator shaft, is forced into the passenger space of an elevator car as the car travels in the shaft. The air flows into the car through slots and baffle plates located in the roof and in the floor of the car. For that purpose, at least one slot is located in the floor region, is formed by an outer car wall and an outer edge of the floor and is covered by internal cladding plates, through which the relieved air flows into the passenger space. Dirt and dust, which is carried from the outside into the car by passengers, deposits on the floor and at least a part thereof gets through the ventilation slot into the cut-out lying thereunder and can, in the course of time, clog the ventilation openings.

The present invention is therefore based on the task of providing a ventilating apparatus for an elevator car with adequate ventilation cross-sectional area and in which dirt, which is deposited on the floor of the car, does not get into the ventilating apparatus.

SUMMARY OF THE INVENTION

The present invention concerns an apparatus for ventilating the passenger space of an elevator car during travel with the car door closed. Air flows through openings of predetermined cross-sectional area above the ceiling and below the floor of the elevator car and this air current produced by the ram pressure of the car flows from the openings through ventilation systems having metal baffle plates and air chambers. A ventilating apparatus has a plurality of ventilation slots formed therein and is mounted in a ventilation channel formed in a wall of the elevator car. The channel is connected to the ventilation system of the car.

The apparatus includes a perforated metal reinforcing plate for protecting against damage to the ventilating apparatus, the plate being perforated by a plurality of apertures aligned with an associated one of the ventilation slots and having a total cross-sectional area at least the same as a cross-sectional area the associated ventilation slot. The reinforcing plate is positioned on a rear side of the ventilation slots. The reinforcing plate is attached to a sheet metal carrier positioned between the plate and the ventilating slots. The carrier has a plurality of carrier slots formed therein and aligned with the ventilation slots, the reinforcing plate having a plurality of generally V-shaped grooves formed therein in which the apertures are formed and being aligned with the ventilation slots for spacing the apertures from the carrier slots.

The advantages of the invention are that a plurality of ventilation slots are provided in at least one side wall of the elevator car and are arranged one above the other above the floor. The slots are formed by strips backed by a metal reinforcing plate which does not reduce the cross-sectional area of the ventilation slots and prevents articles or fingers from being pushed into the ventilation slots.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
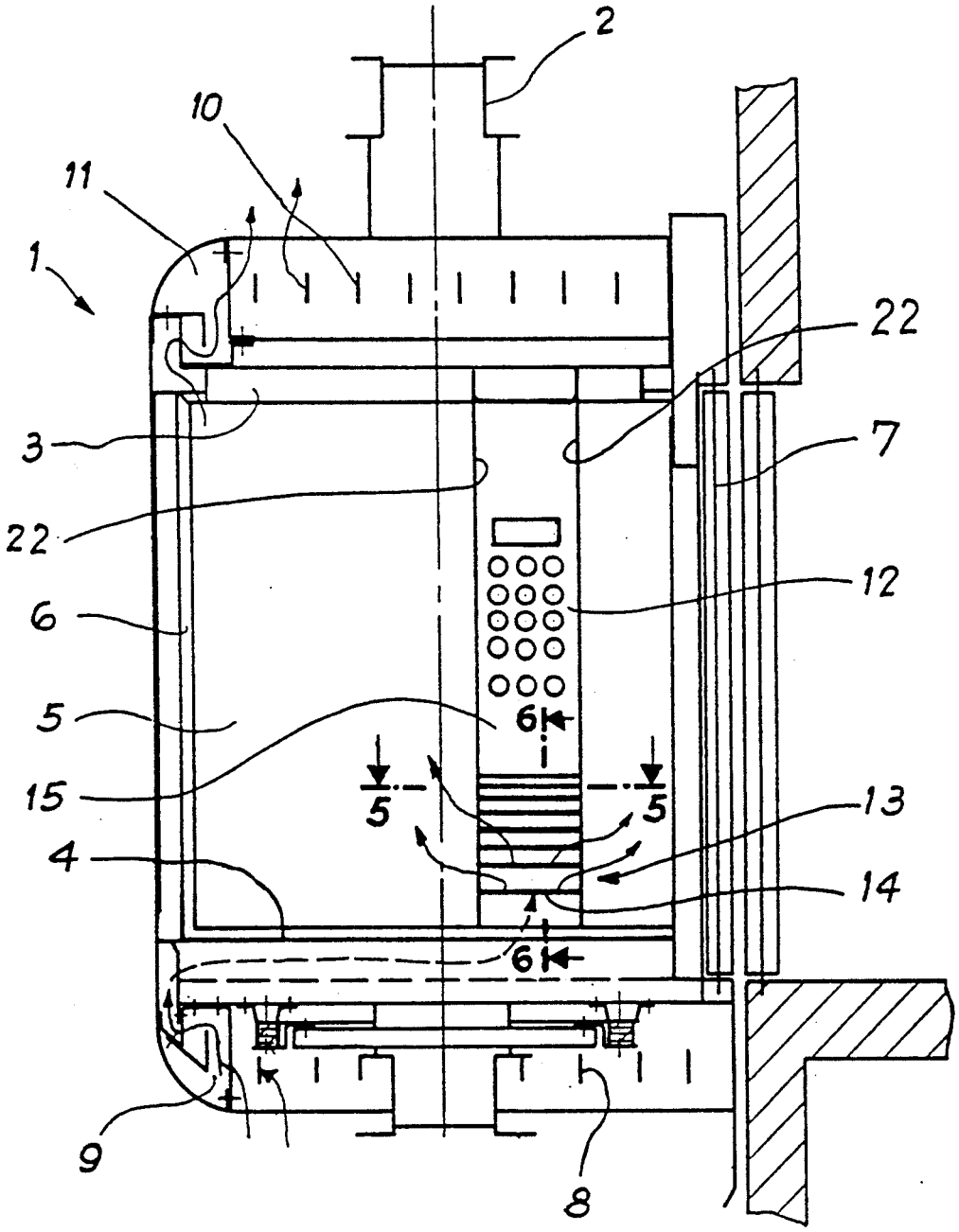
FIG. 1 is a vertical cross-sectional view of a elevator car having a ventilation apparatus in accordance with the present invention.

A elevator car 1 is shown in cross section in the FIG. 1. The elevator car 1 is suspended by a car yoke 2 and includes a ceiling 3, a floor 4, a right-hand side wall 5, a rear wall 6 and a car door 7. A left-hand side wall (not shown) cooperates with the ceiling, floor, walls and door to define a passenger space. Ventilation air openings 8 having a predetermined total cross-sectional area and a ventilating system 9 are provided below the floor 4 and ventilation air openings 10 having the predetermined total cross-sectional area and a ventilating system 11 are provided above the car ceiling 4. The openings 8 open into the ventilating system 9, the openings 10 open into the ventilating system 11 and the ventilating systems 9 and 11 are connected to the passenger space of the car 1. The right-hand side wall 5 has a recess formed therein defined by two vertically extending edge portions 22 wherein the wall 5 extends outwardly at the recess 15 as shown in the FIG. 5. The recess provides a ventilation channel 15 which extends over the entire height of the right-hand side wall 5. An upper portion of the ventilation channel 15 is covered by a control panel 12 and a lower portion is covered by a ventilating apparatus 13 having a number of horizontally extending ventilation slots 14 formed therein one above the other. The ventilation slots 14 are connected by the ventilation channel 15 with the air openings 8 and the ventilation system 9 of the floor 4. The slots 14 provide the required cross-sectional area but are small enough to prevent the insertion of articles and fingers.

Figure 2:
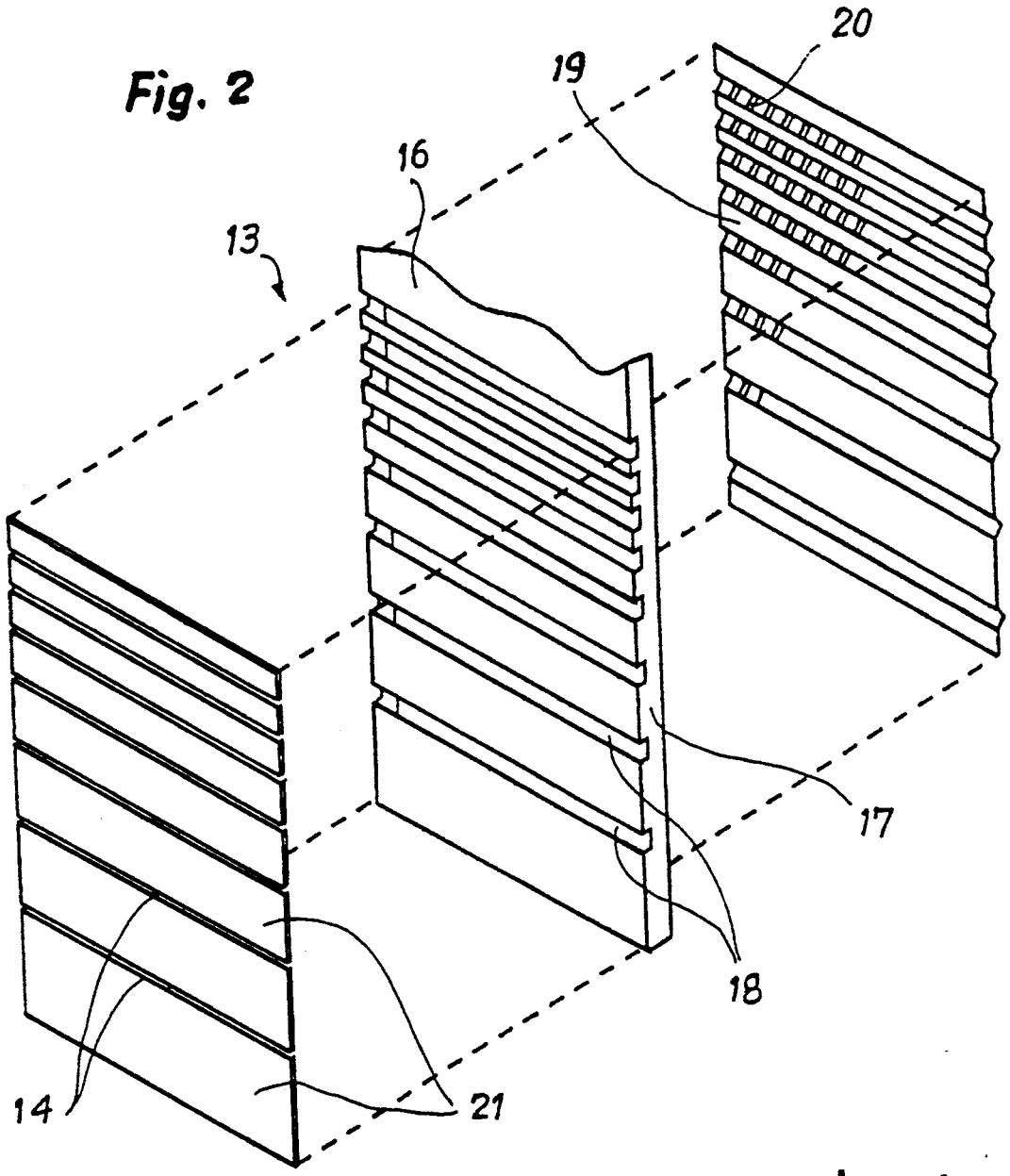
FIG. 2 is an exploded perspective view of a portion of the ventilating apparatus equipment which is located in a side wall of the elevator car shown in the FIG. 1.

The ventilating apparatus 13 is shown in the exploded view of the FIG. 2 as having a generally planar, vertically extending sheet metal carrier 16 having lateral bent-over edges 17 and a plurality of horizontally extending elongated apertures or carrier slots 18 formed therein located one above the other and generally aligned with the ventilation slots 14. The apparatus 13 includes a generally planar, vertically extending perforated metal reinforcing plate 19 positioned behind the carrier 16 and formed with a plurality of rows of apertures 20 generally aligned with the slots 18. The rows of apertures 20 in the reinforcing plate 19 are formed in generally horizontally extending V-shaped grooves which extend across the width of the reinforcing plate 19 and the plate 19 is mounted onto the rear side of the sheet metal carrier 16, for example by spot-welding. A plurality of strips 21 are cut to size, from a sheet of a laminated material for example, and are mounted on the front side of the sheet metal carrier 16, for example by an adhesive material, whereby the ventilation slots 14 are formed as the spaces between adjacent ones of the strips 21. The grooved portions 24 of the metal reinforcing plate 19 have the effect of strengthening the ventilation apparatus against bending from external forces and also space the apertures 20 from the sheet metal carrier 16 and from the carrier slots 18.

Figure 3:
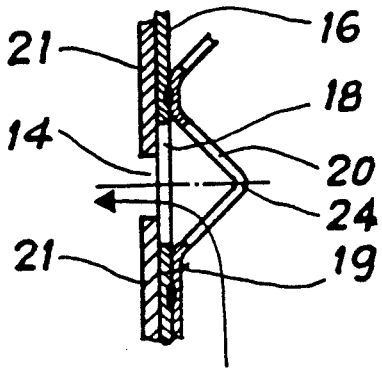
FIG. 3 is an enlarged fragmentary cross-sectional view of a ventilation slot shown in the FIG. 2.
Figure 4:
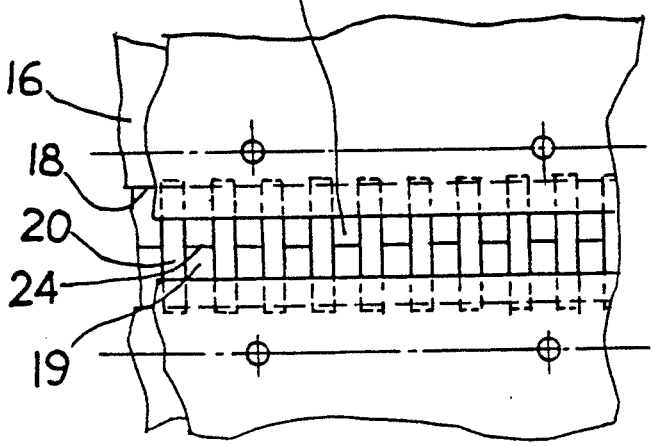
FIG. 4 is an enlarged fragmentary front elevation view of the ventilation slot shown in the FIG. 3.

One of the ventilation slots 14 is illustrated in detail in the FIGS. 3 and 4. A pair of the strips 21 is glued onto the front side of the sheet metal carrier 16 to form one of the ventilation slots 14 aligned with one of the carrier slots 18. The metal reinforcing plate 19 is spot-welded onto the rear side of the carrier 16 with one of the rows of the apertures 20 aligned with the carrier slot 18. As best seen in the FIG. 3, the groove 24 extends outwardly from the carrier 16 and spaces the aperture 20 from the sheet metal carrier 16.

Figure 5:
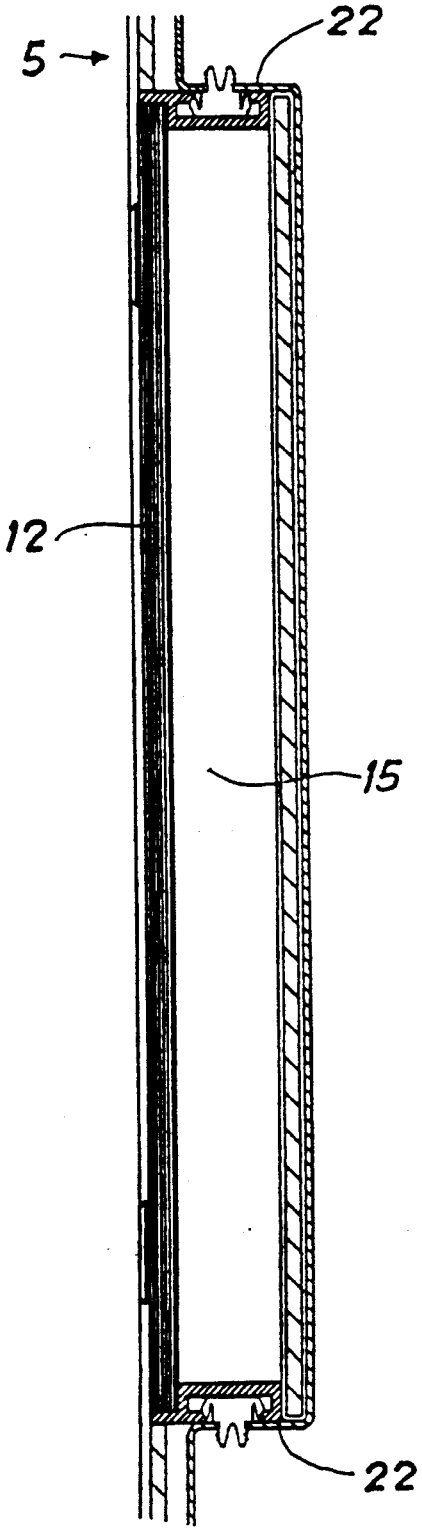
FIG. 5 is a cross-sectional view taken along the line 5—5 in the FIG. 1 and enlarged.
Figure 6:
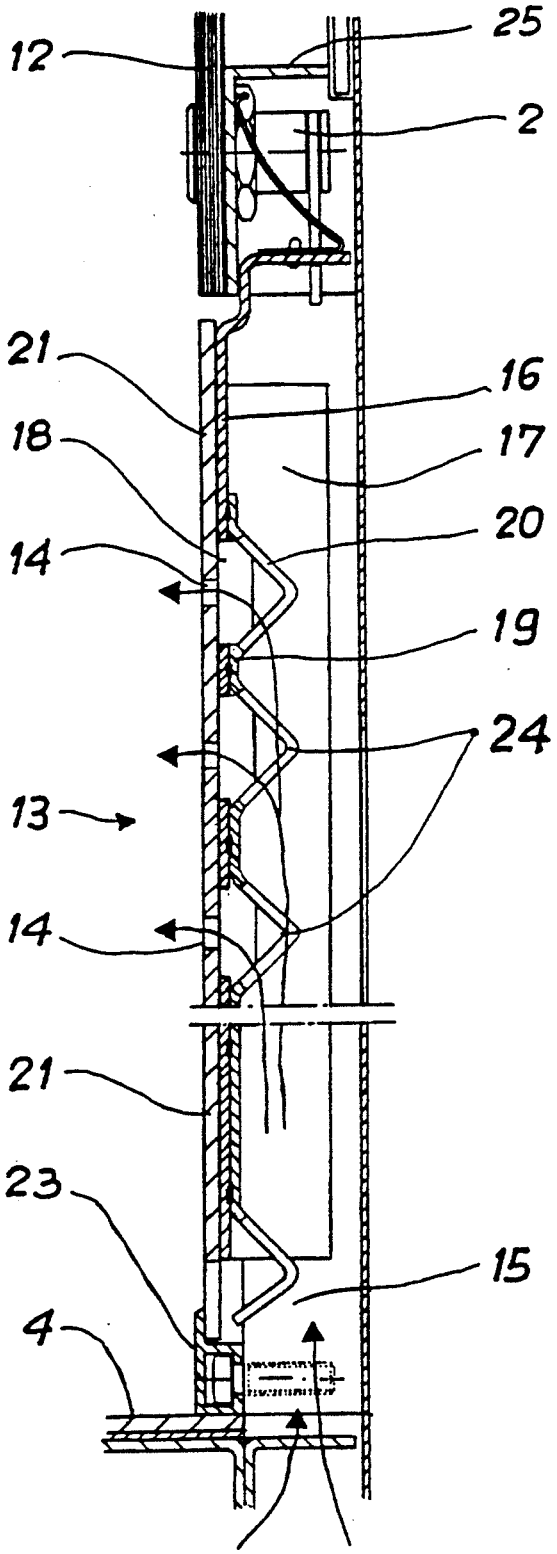
FIG. 6 is a cross-sectional view taken along the line 6—6 in the FIG. 1 and enlarged.

The ventilation channel 15 formed in the right-hand side wall 5 of the elevator car 1 is illustrated in horizontal cross section in the FIG. 5. The side wall 5 has a pair of spaced apart edge portions 22 over its entire height which edge portions 22 extend the wall outwardly to form the ventilation channel 15. The control panel 12 is positioned at the front side in the upper portion of the ventilation channel 15 and the ventilating apparatus 13 is built into the lower portion of the channel 15. The ventilation channel 15 is illustrated in vertical cross section in the FIG. 6 and the installation of the ventilating apparatus 13 in the ventilation channel 15 is visible. The ventilating apparatus 13 is retained on its lower end by a pedestal strip 23 and on its upper end by the control panel 12. The ventilation channel 15 is blocked by a terminating flange 25 attached to a lower end of the control panel 12 and the ventilation slots 14 open the lower end of the channel 15 into the ventilating system 9 of the floor 4.

The above described apparatus operates as follows: The total cross-sectional area of all of the ventilation slots 14 of the ventilating apparatus 13 is approximately twice the cross-sectional area of the ventilating channel 15. For the downward direction of travel of the car 1, the air in the elevator shaft, which has flowed into the openings 8 and the ventilating system 9 of the floor 4, flows through the ventilation channel 15 and out through the ventilation slots 14 of the ventilating apparatus 13 into the passenger space of the elevator car 1. Due to the cross-sectional area relationships mentioned above, the speed of the air flow into the passenger space is relatively low so that the noise of the inflowing air is hardly audible and does not disturb the passengers. The air exits the passenger space through the ventilating system 11 and the air openings 10 of the ceiling 3. For the upward direction of travel of the car 1, the air flow is in the opposite direction from that just described.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A ventilating apparatus for the ventilation of the passenger space of a rapidly moving elevator car, the car having a plurality of openings of predetermined cross-sectional area formed above the ceiling and below the floor of the car, the openings opening into ventilation systems connected with a passenger space in the car, ventilation of the car during travel with the car door closed taking place through air flow produced by the ram pressure of the car moving in the elevator shaft, comprising: a plurality of generally parallel extending strips being spaced apart to form ventilation slots therebetween, said strips for covering a ventilation channel formed in at least one wall of an elevator car, the channel being connected to a ventilation system of the car, and a perforated metal reinforcing plate for protecting against damage to said ventilating apparatus, said plate being perforated by a plurality of apertures aligned with an associated one of said ventilation slots and having a total cross-sectional area at least the same as a cross-sectional area of said associated ventilation slot, said plate being positioned on a rear side of said strips and being connected to said strips for mounting in the ventilation channel.

2. The ventilating apparatus according to claim 1 including a sheet metal carrier having said strips attached to a front surface thereof and said plate attached to a rear surface thereof, said carrier having a plurality of carrier slots formed therein and aligned with said ventilation slots, said plate having a plurality of generally V-shaped grooves formed therein in which said apertures are formed and being aligned with said ventilation slots for spacing said apertures from said carrier slots.

3. The ventilating apparatus according to claim 1 wherein said ventilation slots have a total cross-sectional area at least twice as great as a cross-sectional area of the ventilation channel.

4. The ventilating apparatus according to claim 1 wherein the ventilation channel extends generally vertically and has an upper portion and a lower portion, said ventilation apparatus is positioned at the lower portion of the ventilation channel, the ventilation channel being formed by a pair of edge portions extending the one wall outwardly therebetween, said strips and said ventilation slots extending generally horizontally and located one above the other and wherein the upper portion of the ventilation channel is covered by a control panel.

5. The ventilating apparatus according to claim 1 wherein said strips are formed of a laminated material.

6. A ventilating apparatus for the ventilation of the passenger space of a rapidly moving elevator car, the car having a plurality of openings of predetermined cross-sectional area formed above the ceiling and below the floor of the car, the openings opening into ventilation systems connected with a passenger space in the car, ventilation of the car during travel with the car door closed taking place through air flow produced by the ram pressure of the car moving in the elevator shaft, comprising:

a pair of edge portions extending outwardly in a wall of an elevator car to form a ventilation channel therebetween, the ventilation channel being connected to a ventilation system of the car;

a plurality of spaced apart, generally parallel extending strips forming a plurality of ventilation slots therebetween; and a perforated metal reinforcing plate mounted between said edge portions in the ventilation channel and having said strips connected thereto, said plate protecting against damage to said ventilating apparatus, said plate being perforated by a plurality of apertures aligned with an associated one of said ventilation slots and having a total cross-sectional area at least the same as a cross-sectional area of said associated ventilation slot, said plate being positioned on a rear side of said strips.

7. The ventilating apparatus according to claim 6 including a sheet metal carrier having a plurality of carrier slots formed therein and aligned with said ventilation slots, said carrier being positioned between and attached to said strips and said plate.

8. The ventilating apparatus according to claim 7 wherein said plate has a plurality of generally V-shaped grooves formed therein in which said apertures are formed and which are aligned with said ventilation slots for spacing said apertures from said carrier slots.

9. The ventilating apparatus according to claim 6 wherein said ventilation slots have a total cross-sectional area at least twice as great as a cross-sectional area of the ventilation channel.

10. An apparatus for the ventilation of the passenger space of a rapidly moving elevator car, the car having a plurality of openings formed above the ceiling and below the floor of the car, the openings opening into ventilation systems connected with a passenger space in the car, ventilation of the car during travel with the car door closed taking place by air flow through the openings produced by the ram pressure of the car moving in the elevator shaft, comprising:

a pair of spaced apart edges portions in a wall of an elevator car forming a ventilation channel therebetween, the ventilation channel being connected to a ventilation system of the car;

a plurality of spaced apart strips forming a plurality of ventilation slots therebetween;

a perforated metal reinforcing plate mounted between said edge portions in the ventilation channel and having said strips connected thereto, said plate protecting against damage to said ventilating apparatus, said plate being perforated by a plurality of apertures aligned with an associated one of said ventilation slots and having a total cross-sectional area at least the same as a cross-sectional area of said associated ventilation slot, said plate being positioned on a rear side of said strips; and a sheet metal carrier having a plurality of carrier slots formed therein and aligned with said ventilation slots, said carrier being positioned between and attached to said strips and said plate.

11. The ventilating apparatus according to claim 10 wherein said plate has a plurality of generally V-shaped grooves formed therein in which said apertures are formed and which are aligned with said ventilation slots for spacing said apertures from said carrier slots.

* * * * *